US009925575B2

(12) United States Patent
Gaensbauer et al.

(10) Patent No.: US 9,925,575 B2
(45) Date of Patent: Mar. 27, 2018

(54) HYBRID OIL AND WATER COOLED ROLLING

(71) Applicant: NOVELIS INC., Atlanta, GA (US)

(72) Inventors: David Gaensbauer, Atlanta, GA (US); Jim McNeil, Madison, GA (US)

(73) Assignee: Novelis Inc., Atlanta, GA (US)

( * ) Notice: Subject to any disclaimer, the term of this patent is extended or adjusted under 35 U.S.C. 154(b) by 72 days.

(21) Appl. No.: 14/707,460

(22) Filed: May 8, 2015

(65) Prior Publication Data

US 2015/0321235 A1 Nov. 12, 2015

Related U.S. Application Data

(60) Provisional application No. 61/990,890, filed on May 9, 2014.

(51) Int. Cl.

| | |
|---|---|
| ***B21B 27/10*** | (2006.01) |
| ***B21B 45/02*** | (2006.01) |
| ***B21B 37/32*** | (2006.01) |
| *B21B 38/02* | (2006.01) |

(52) U.S. Cl.

CPC ..... *B21B 45/0233* (2013.01); *B21B 27/10* (2013.01); *B21B 37/32* (2013.01); *B21B 38/02* (2013.01); *B21B 2027/103* (2013.01); *Y10T 29/49718* (2015.01)

(58) Field of Classification Search

CPC ..... B21B 1/28; B21B 27/10; B21B 2027/103; B21B 37/28; B21B 27/32; B21B 45/0203; B21B 45/0218; B21B 45/0239; B21B 45/0251; B21B 38/006; B21B 38/02;

(Continued)

(56) References Cited

U.S. PATENT DOCUMENTS 2,957,349 A * 10/1960 Holowaty ..... B21B 27/10 269/15
3,802,237 A * 4/1974 Albensi ..... B21B 37/32 72/200

(Continued)

FOREIGN PATENT DOCUMENTS

CA 2067140 C 12/2000
CN 202606498 U 12/2012

(Continued)

OTHER PUBLICATIONS

Translation, JP 11-267717A, Oct. 5, 1999.*

(Continued)

*Primary Examiner* — Edward Tolan

(74) *Attorney, Agent, or Firm* — Kilpatrick Townsend & Stockton LLP

(57) ABSTRACT

A rolling mill with oil-cooled top and bottom work rolls at the entry side and a water spray header at the exit side of the bottom work roll. Water cooling is used below the pass line, reducing the heat in the mill substantially without the risk of generating drip-related surface defects during rolling. Water cooling can be used on the bottom work roll and a portion of the oil no longer needed to cool the bottom work roll can be diverted to the top work roll. In some cases, the coolant portion of the flatness control can be operated solely through water-cooling the bottom roll.

18 Claims, 6 Drawing Sheets

(58) Field of Classification Search
CPC ..... B21B 45/0233; B21B 2267/12; B21B 2267/19; B21B 37/32
See application file for complete search history.

(56) References Cited

U.S. PATENT DOCUMENTS

| | | | | | |
|---|---|---|---|---|---|
| 3,911,704 | A * | 10/1975 | Bridenbaugh | B21B 45/0251 | 72/236 |
| 4,750,343 | A | 6/1988 | Richter et al. | | |
| 7,266,984 | B2 * | 9/2007 | Cerv | B21B 45/0251 | 72/236 |
| 7,434,435 | B2 * | 10/2008 | Richter | B21B 37/28 | 72/201 |
| 7,690,235 | B2 * | 4/2010 | Buenten | B21B 27/10 | 72/201 |
| 8,387,433 | B2 * | 3/2013 | Berghs | B21B 37/32 | 72/10.2 |
| 2008/0087066 | A1 * | 4/2008 | Takahama | B21B 1/28 | 72/45 |
| 2013/0019647 | A1 * | 1/2013 | Inoue | B05B 12/084 | 72/43 |
| 2014/0060135 | A1 * | 3/2014 | Pawelski | B21B 27/10 | 72/41 |

FOREIGN PATENT DOCUMENTS

| | | | | | |
|---|---|---|---|---|---|
| CN | 103252349 | A | | 8/2013 | |
| DE | 3419261 | A1 | | 11/1985 | |
| EP | 0794023 | A2 | | 9/1997 | |
| JP | 54-62153 | A | * | 5/1979 | B21B 2267/19 |
| JP | 55-147407 | A | * | 11/1980 | B21B 37/00 |
| JP | 59-169612 | A | * | 9/1984 | B21B 37/00 |
| JP | S61014009 | A | | 1/1986 | |
| JP | H06335714 | A | | 12/1994 | |
| JP | H07284820 | A | | 10/1995 | |
| JP | H09174121 | A | | 7/1997 | |
| JP | 11267717 | A | | 10/1999 | |
| JP | 2005205432 | A | | 8/2005 | |
| WO | 03002277 | A1 | | 1/2003 | |

OTHER PUBLICATIONS

Translation, JP55-147707 A, Nov. 1980.*
Machine Translation, Kokubo et al. JP 59-169612, Sep. 1984.*
PCT/US2015/029878, "International Search Report and Written Opinion", dated Jul. 22, 2015, 12 pages.
PCT/US2015/029878, "International Preliminary Report on Patentability", dated Nov. 24, 2016, 8 pages.
Chinese Patent Application No. 201580024413.6, Office Action dated Nov. 1, 2017, 20 pages.
Canadian Patent Application No. 2,947,980, Office Action dated Nov. 15, 2017, 4 pages.
Korean Patent Application No. 10-2016-7034544, Office Action dated Jul. 6, 2017, 15 pages.
Korean Patent Application No. 10-2016-7034544, Notice of Final Rejection dated Dec. 22, 2017, 5 pages with English translation.

* cited by examiner

HYBRID OIL AND WATER COOLED ROLLING

CROSS REFERENCE TO RELATED APPLICATIONS

The present application claims the benefit of U.S. Provisional Application No. 61/990,890 filed on May 9, 2014 entitled "WATER-COOLED ROLLING," which is hereby incorporated by reference in its entirety.

TECHNICAL FIELD

The present disclosure relates to metal rolling generally and more specifically to rolling using a combination of oil and water cooling.

BACKGROUND

Rolling is a metal forming process in which stock sheets or strips are passed through a pair of work rolls to reduce the thickness of the stock sheet or strip. During the rolling process, the work rolls are commonly cooled with oil, and can become very hot. High heat in the work rolls can lead to undesirable strip flatness, low productivity, and strip breaks with subsequent risk of fire. Work rolls can alternatively be cooled with water, which has a much higher heat removal capability than oil and is not flammable. Water-cooled mills, however, are expensive and difficult to design, install, maintain, and operate, and water drip-related surface defects can appear on strips rolled in a water-cooled mill. Strips with water drip-related surface defects may be unsuitable for sale or further production. Accordingly much of the cost of a water-cooled mill is in creating coolant containment systems that prevent any water from above the pass line (e.g., the path the strip takes through the mill) falling on the strip.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Aspects of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Disclosed are systems and methods for cooling work rolls during rolling. According to certain aspects of the present disclosure, water cooling is applied to the bottom roll on the exit side of the roll and oil cooling is applied on the entry side to the top and bottom rolls. In some cases, a portion of the oil no longer needed to cool the bottom work roll can be diverted to the top work roll.

BRIEF DESCRIPTION OF THE DRAWINGS

The specification makes reference to the following appended figures, in which use of like reference numerals in different figures is intended to illustrate like or analogous components.

DETAILED DESCRIPTION

The present disclosure relates to a rolling mill with oil-cooled top and bottom work rolls at the entry side and water-cooling at the exit side of the bottom work roll. Water cooling can be used only below the pass line, reducing the heat in the mill substantially without the risk of dripping on the top surface of the rolled strip. Water cooling can be used to completely manage the heat on the bottom work roll, so only a small amount of oil for lubrication purposes needs to be used on the bottom work roll, with the remaining amount of oil no longer needed to cool the bottom work roll being diverted to the top work roll for additional cooling of the top roll. In some cases, the coolant portion of the flatness control can be operated solely through water-cooling the bottom roll. The present disclosure allows the benefits of water-cooled rolling to be leveraged while eliminating the complex water containment equipment needed above the pass line by keeping all of the water below pass line.

Additionally, the present disclosure relates to retrofitting an oil-cooled rolling mill with a water spray header at the exit side of the bottom work roll. When rolling hard metals (e.g., strips receiving a prior cold-rolling pass, or work-hardened metal), water cooling can be used on the bottom work roll while oil cooling can be used on both work rolls. When rolling soft metals (e.g., strips coming from an annealing furnace, or non-work-hardened metal), only oil cooling can be used. The present disclosure allows a retrofit rolling mill to better handle both soft and hard metals with improved flatness and without the expense of completely retrofitting an oil-cooled mill to become a fully water-cooled mill.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

Figure 1:
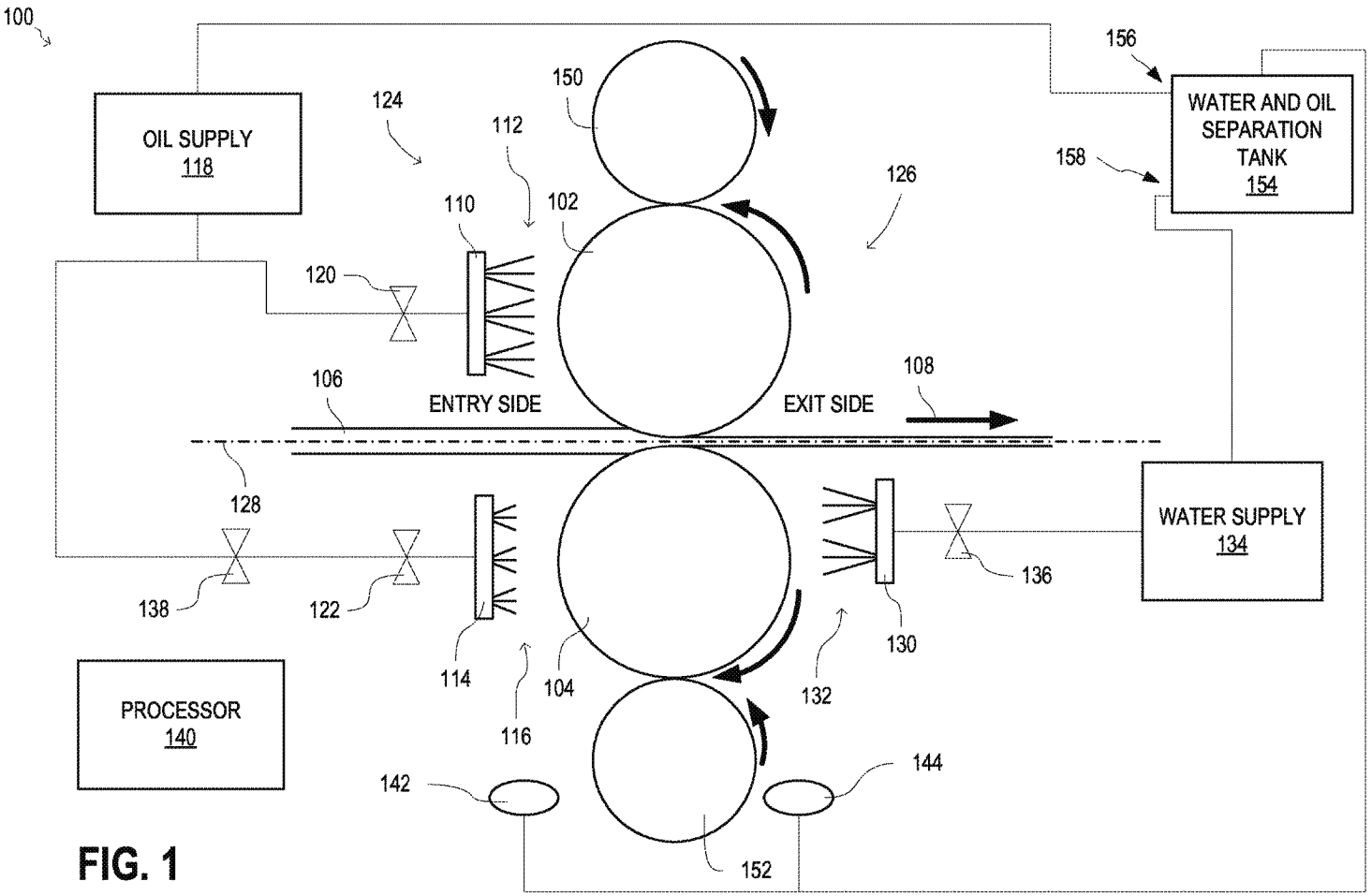
FIG. 1 is a schematic diagram illustrating a metal strip being rolled according to certain aspects of the present disclosure.

FIG. 1 is a schematic diagram illustrating a metal strip 106 being rolled according to certain aspects of the present disclosure. A rolling mill 100 includes a top work roll 102 and a bottom work roll 104. The top work roll 102 and bottom work roll 104 are rolling the strip 106 as the strip 106 moves in the direction 108. The strip 106 enters the work rolls 102, 104 on the entry side 124 and exits on the exit side 126. During the rolling procedure, the top work roll 102 and the bottom work roll 104 both become hot and must be cooled. A top backup roll 150 can supply force to the top work roll 102 and a bottom backup roll 152 can supply force to the bottom work roll 104.

The water-cooling aspects of the present disclosure can be added to an existing oil-cooled rolling mill or integrated with oil-based cooling/lubrication in a new rolling mill. Oil-based cooling/lubrication in an existing oil-cooled rolling mill or a new rolling mill can include oil supplies, headers, valves, and other features as described herein.

A top oil spray header 110 is positioned proximate the top work roll 102 at the entry side 124. The top oil spray header 110 is positioned above the pass line 128. The top oil spray header 110 includes one or more nozzles that emit a top oil spray 112 that lubricates and cools the top work roll 102. A bottom oil spray header 114 is positioned proximate the bottom work roll 104 at the entry side 124. The bottom oil spray header 114 is positioned below the pass line 128. The bottom oil spray header 114 includes one or more nozzles that emit a bottom oil spray 116 that lubricates and cools the bottom work roll 104.

The top oil spray header 110 and bottom oil spray header 114 that are fed from an oil supply 118. A top oil valve 120 controls the timing and amount of the top oil spray 112 through the top oil spray header 110 and a bottom oil valve 122 controls the timing and amount of the bottom oil spray 116 through the bottom oil spray header 114. In other cases, different oil emitting devices may be used to cool and/or lubricate the top work roll 102 and bottom work roll 104, including any number of valves and nozzles. In some cases, the top oil spray header 110 and/or bottom oil spray header 114, or other oil emitting devices, can be positioned on the entry side 124 or exit side 126. The top oil spray header 110 and bottom oil spray header 114 make up the oil-based cooling system.

A water spray header 130 is positioned on the exit side 126 proximate the bottom work roll 104. The water spray header 130 is positioned below the pass line 128. The water spray header 130 includes one or more individual nozzles that emit a water spray 132 that cools the bottom work roll 104. The water spray header 130 is fed from a water supply 134. A water valve 136 controls the timing and amount of the water spray 132 through the water spray header 130. In other cases, different water emitting devices may be used to cool the bottom work roll 104, including any number of valves and nozzles. The valves and nozzles in the spray header may be aligned with measuring zones of the mill's flatness measurement system, as discussed in further detail below. The water spray header 130 and its components can make up the in-mill portion of water-based cooling system.

In some cases, water sprayed onto the bottom work roll 104 is removed from the bottom work roll 104 before it has the chance to come in contact with the strip 106, such as by being rolled into the bottom surface of the strip 106. In some cases, the water sprayed onto the bottom work roll 104 is removed from the bottom work roll 104 by the bottom backup roll 152 acting as a squeegee. In some cases, the water sprayed onto the bottom work roll 104 is removed from the bottom work roll 104 by a wiper blade (not shown) that is installed adjacent the bottom work roll 104. In some cases, the water spray header 130 can be positioned on the exit side 126. Alternatively or additionally, the water spray header 130 can be positioned on the entry side 124, but only when a wiper blade or other mechanism is used to remove water from the bottom work roll 104 before that water has an opportunity to be rolled into the strip 106.

Because the rolling mill 100 does not have any water-cooling device proximate the top work roll 102, water does not drop from a water-cooling device onto the strip 106 and cause drip-related surface defects commonly associated with water-cooled cold mills.

Each of the top oil spray header 110, bottom oil spray header 114, and water spray header 130 may include sufficient nozzles and valves to spray the full longitudinal axis (e.g., in a direction extending out of the page as viewed in FIG. 1) of the top work roll 102 and bottom work roll 104, as applicable.

Because the water spray 132 is able to cool the bottom work roll 104 very efficiently, oil may be diverted from the bottom oil spray header 114 to the top oil spray header 110. One or both of the top oil valve 120 and bottom oil valve 122 are adjusted to divert the oil accordingly. A pressure reducing valve 138 inline with the bottom oil spray header 114 may be used to reduce the pressure of the bottom oil spray 116 and divert the oil to the top oil spray header 110. When the oil is diverted, the bottom oil spray 116 is weaker than the top oil spray 112. In some circumstances, the bottom oil spray 116 provides only enough oil necessary to provide sufficient lubrication for rolling. In other words, water-based cooling can be used to extract a majority of the heat extracted through the combination of water-based and oil-based cooling. The top oil spray header 110 may, but need not, include more nozzles than the bottom oil spray header 114.

A processor 140 may be connected to sensing equipment and the top oil valve 120, the bottom oil valve 122, and the water valve 136. The processor 140 controls each valve 120, 122, 136 to provide optimal cooling to the top work roll 102 and bottom work roll 104 utilizing both oil- and water-based cooling. The processor 140 can control flatness of the strip 106 once rolled by adjusting the cooling profile provided to the top work roll 102 and bottom work roll 104. The processor 140 may control the cooling profile of the top work roll 102 by making adjustments to the top oil spray 112 and controls the cooling profile of the bottom work roll 104 by making adjustments to the water spray 132. In such cases, the processor 140 does not control the cooling profile of the bottom work roll 104 by making adjustments to the bottom oil spray 116.

Figure 2:
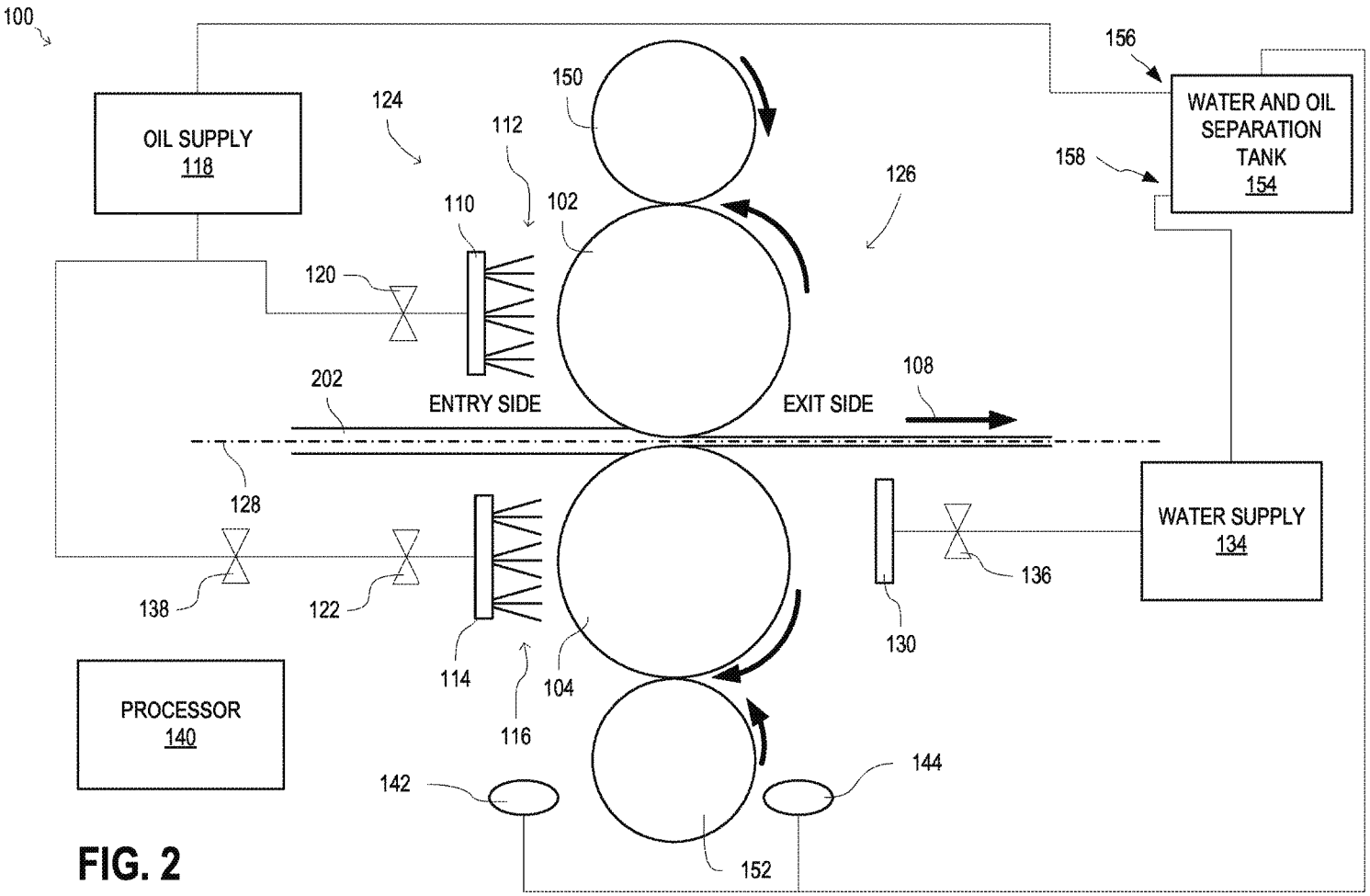
FIG. 2 is a schematic diagram illustrating a soft metal strip being rolled according to certain aspects of the present disclosure.

FIG. 2 is a schematic diagram illustrating a soft metal strip 202 being rolled according to certain aspects of the present disclosure. Because the amount of cooling necessary when rolling soft metal is less than when rolling hard metal, a rolling mill 100 sometimes may use only oil-based cooling systems when rolling soft metals, as seen in FIG. 2. Because only oil-based cooling systems are being used, similar volumes of oil are being emitted with the top oil spray 112 and bottom oil spray 116. The water valve 136 may be off.

If additional cooling is needed, the water-based cooling can be initiated by turning the water valve 136 on. At that time, oil can be diverted from the bottom oil spray 116 to the top oil spray 112 to provide additional oil-based cooling to the top work roll 102 while the bottom work roll 104 is cooled by both oil-based and water-based cooling.

An oil drain 142 and a water drain 144 may be separate from the oil drain 143 are provided. The oil drain 142 collects used oil and directs the used oil through an oil filter back to the oil supply 118. The water drain 144 collects used water and directs the water through a water filter back to the water supply 134. In some cases, the water spray 132 is contained towards the centerline of the mill on the exit side 126 to keep the water from mixing in with the bottom oil spray 116 from the entry side 124.

In some cases, a common drain (e.g., a single drain or multiple drains feeding to a single location) is used and filtering and separating processes are used to separate the oil from the water. The water and oil from the common drain (e.g., water drain 144 and oil drain 142) can be collected in a water and oil separation tank 154. Since the oil will naturally float on the water in the water and oil separation tank 154, the water and oil separation tank 154 can include a top port (e.g., an oil extraction port 156) from which oil is collected and provided to the oil supply 118, and a bottom port (e.g., a water extraction port 158) from which water is collected and provided to the water supply 134. Other mechanisms and equipment can be used to separate the oil from the water for re-supplying each of the oil supply 118 and water supply 134.

Figure 3:
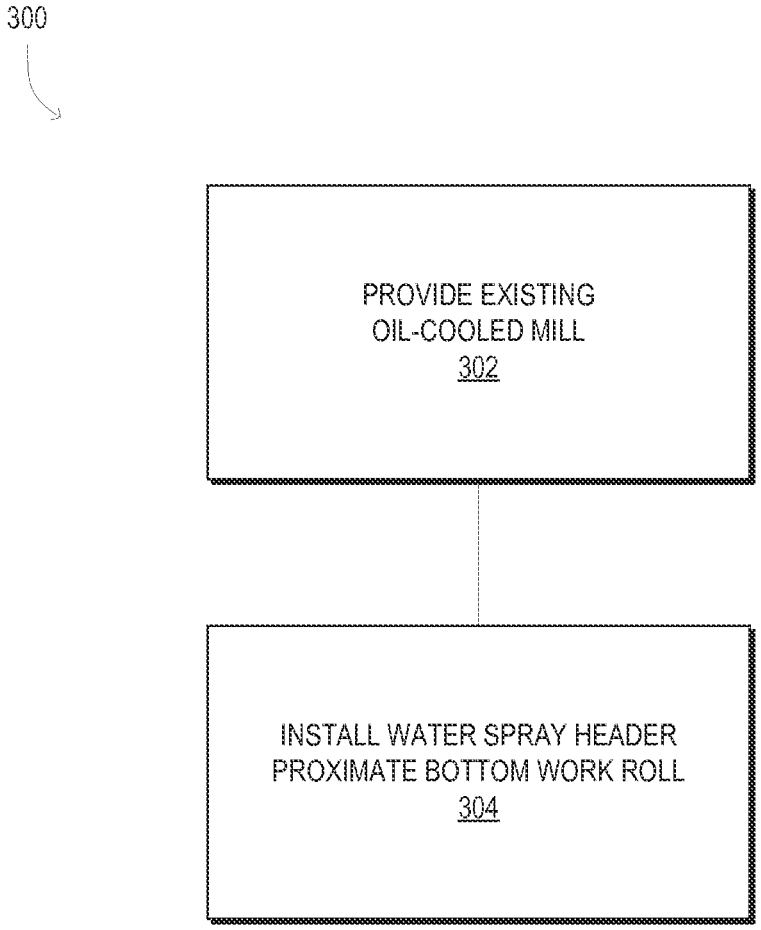
FIG. 3 is a flow chart of a method of upgrading an existing mill according to certain aspects of the present disclosure.

FIG. 3 is a flow chart of a process 300 of upgrading an existing mill according to certain aspects of the present disclosure. An existing oil-cooled mill is provided at block 302. At block 304, a water spray header is installed proximate the bottom work roll. Also at block 304, any additional controls and equipment necessary to operate the water spray header as described herein is installed.

Figure 4:
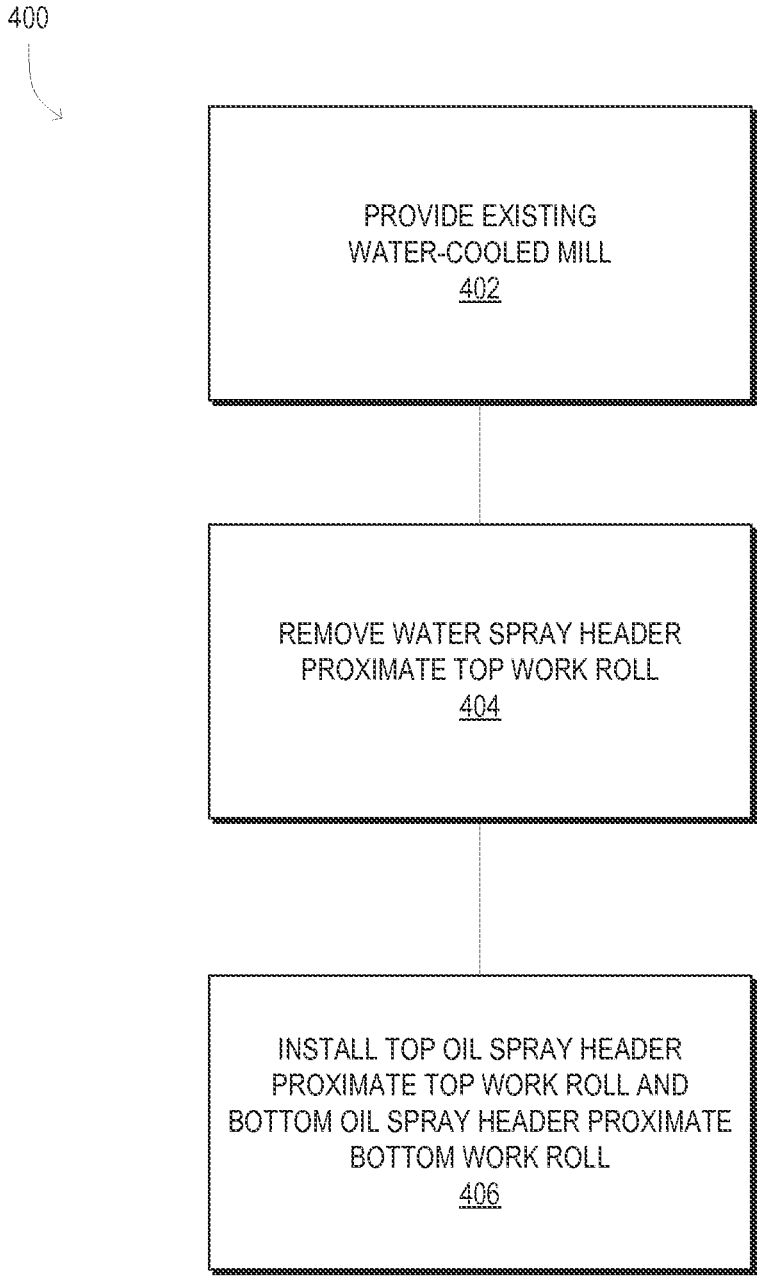
FIG. 4 is a flow chart of a method of upgrading an existing mill according to certain aspects of the present disclosure.

FIG. 4 is a flow chart of a process 400 of upgrading an existing mill according to certain aspects of the present disclosure. An existing water-cooled mill is provided at block 402. At block 404, the water spray header proximate the top work roll is removed. At block 406, a top oil spray header is installed proximate the top work roll and a bottom oil spray header is installed proximate the bottom work roll. Also at block 406, any additional controls and equipment necessary to operate the top oil spray header and bottom oil spray header as described herein are installed.

Figure 5:
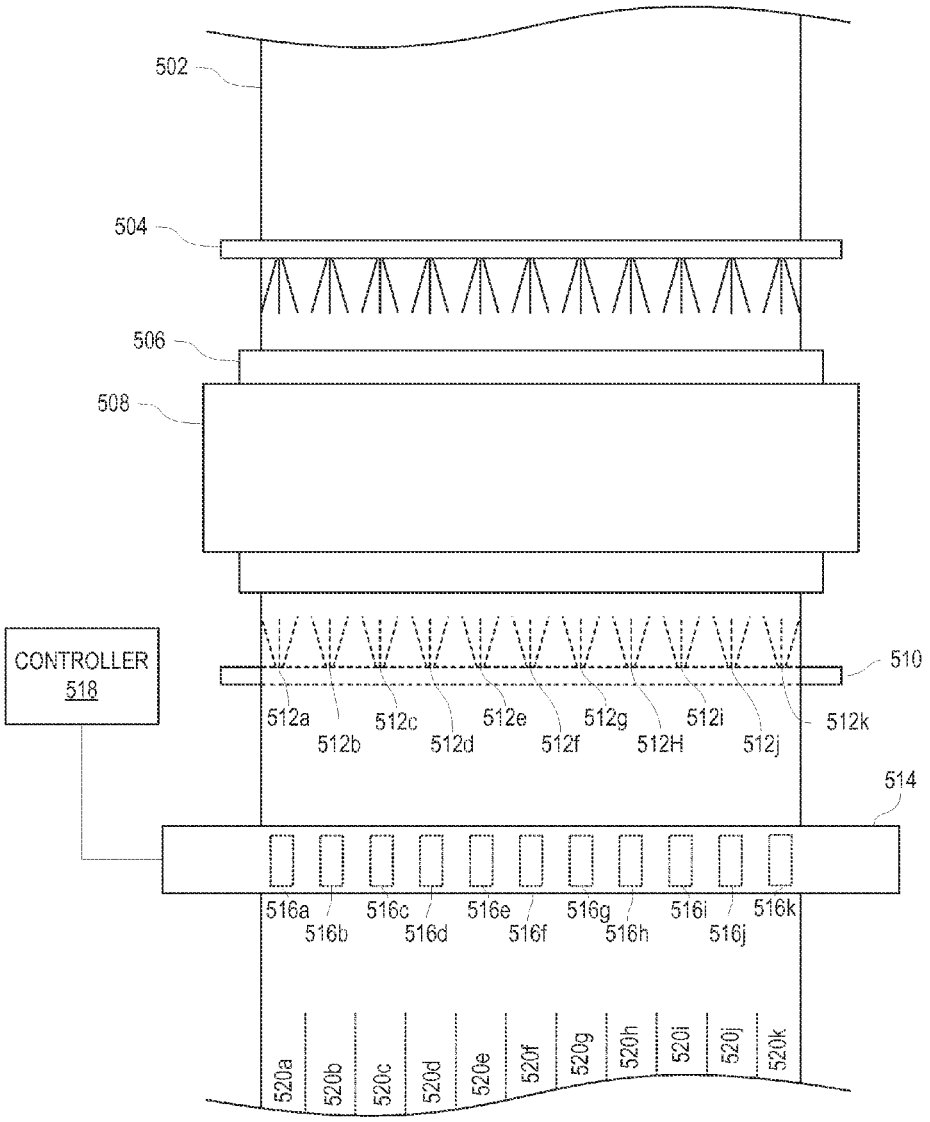
FIG. 5 is a top-view schematic diagram of a metal strip being rolled according to certain aspects of the present disclosure.

FIG. 5 is a top-view schematic diagram of a metal strip 502 being rolled according to certain aspects of the present disclosure. The metal strip 502 passes through a bottom work roll (not seen) and a top work roll 506. The top work roll is supported by a top backup roll 508. A top oil header 504 is placed adjacent the top work roll 506 and a bottom oil header (not seen) is placed adjacent the bottom work roll to spray oil onto the work rolls for lubrication and cooling purposes. A water spray header 510 is positioned under the strip 502 and adjacent the bottom work roll to spray water onto the bottom work roll.

A flatness measurement system 514 can be positioned adjacent the strip 502. The flatness measurement system 514 can be positioned at a location after the work rolls (e.g., after the strip 502 has been rolled by the work rolls). The flatness measurement system 514 can be coupled with controller 518 to provide measurement signals indicative of the flatness of the strip 502. Based on these signals, a controller 518 (e.g., one or more application specific integrated circuits (ASICs), digital signal processors (DSPs), digital signal processing devices (DSPDs), programmable logic devices (PLDs), field programmable gate arrays (FPGAs), processors, micro-controllers, microprocessors, other electronic units designed to perform the functions described herein, and/or a combination thereof) can control cooling of the top and/or bottom work rolls in order to achieve a desired flatness (e.g., lateral flatness) of the strip 502.

The flatness measurement system 514 may include one or more sensors 516*a*-516*k* (e.g., internal transducers or load cells of a flatness measuring roll) that detect the flatness of the strip 502 across one or more lateral zones 520*a*-520*k* of the strip 502. While eleven sensors and lateral zones are shown in FIG. 5, any number of sensors and lateral zones can be used. In some cases, the number of lateral zones is the same as the number of sensors. While a flatness measuring roll is shown as the particular flatness measurement system 514, and suitable flatness measurement device can be used.

In some cases, the controller 518 uses measurement signals from the flatness measurement system 514 to provide flatness control through mechanisms other than cooling of the work rolls.

In some cases, the controller 518 uses measurement signals from the flatness measurement system 514 to provide flatness control by selectively cooling certain lateral portions of the work rolls more than other portions. Such controlled cooling can include control of oil being sprayed onto one or both of the work rolls (e.g., oil from top oil header 504), control of water being sprayed onto the bottom work roll, or any combination thereof. For example, when a flatness measurement is received indicating undesirable flatness in a particular lateral zone (e.g., lateral zone 520*e*), the controller 518 can send signals to decrease cooling of the respective lateral portion(s) of one or both work rolls, allowing the work roll(s) to proportionally expand slightly at that lateral position.

Controlled cooling using the water spray header 510 can be accomplished by the water spray header 510 having several individually-controllable nozzles 512*a*-512*k* laterally spaced apart across the water spray header 510. Being laterally spaced apart, the nozzles 512*a*-512*k* are therefore positioned laterally across a width of the bottom work roll. While eleven nozzles 512*a*-512*k* are shown in FIG. 5, any number of nozzles can be used. In some cases, each nozzle 512*a*-512*k* is associated with a respective lateral zone 520*a*-520*k* and therefore associated with a respective sensor 516*a*-516*k* of the flatness measurement system 514. Each nozzle 512*a*-512*k* can be controlled (e.g., to decrease or increase the water flow) based on control signals from the controller 518. Therefore, measurements from a particular sensor 516*a*-516*k* can be leveraged by the controller 518 to control the amount of water flow of respective nozzles 512*a*-512*k*, thus controlling the amount of cooling applied to particular lateral segments of the bottom work roll.

Controlled cooling using oil headers can be similarly accomplished by an oil header (e.g., top oil header 504) including a plurality of individually-controllable nozzles through which the oil is sprayed. Control signals from the controller 518, based on the measurement signals from the flatness measurement system 514, can control how much oil flows out of each of the individually-controllable nozzles. Each individually-controllable nozzle can be associated with a respective lateral zone 520*a*-520*k* of the strip 502. One or both oil headers can be controlled thusly.

In some cases, a combination of oil-based and water-based cooling is controlled by the controller 518 based on measurement signals from the flatness measurement system 514.

In some cases, water-based cooling can be used to evenly extra a majority of the heat from the bottom work roll, while oil-based cooling is used to provide controllable cooling of the bottom work roll based on feedback from the flatness measurement system 514.

Figure 6:
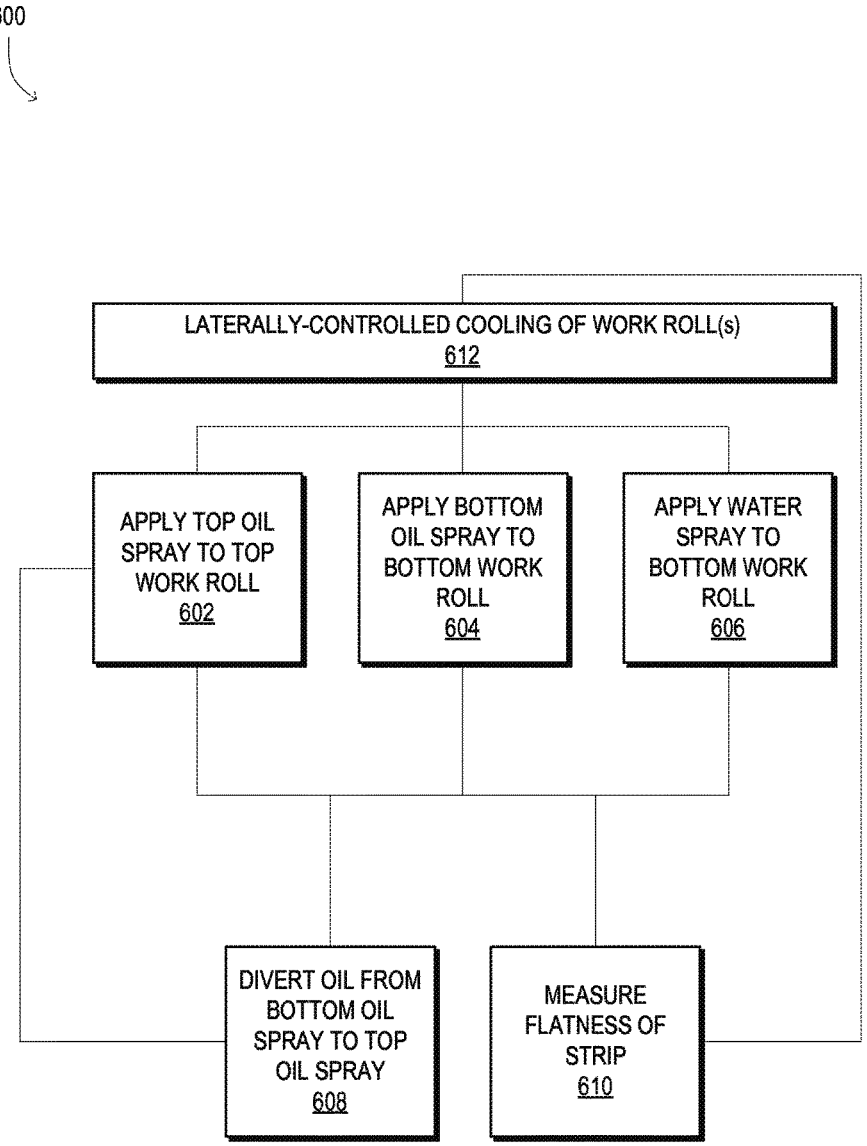
FIG. 6 is a flowchart depicting a method of cooling work rolls of a rolling mill, according to certain aspects of the present disclosure.

FIG. 6 is a flowchart depicting a method 600 of cooling work rolls of a rolling mill, according to certain aspects of the present disclosure. The method 600 can occur while a metal strip is being rolled by work rolls. At block 602, oil can be sprayed on to the top work roll to cool the roll. At block 604, oil can be sprayed on the bottom work roll to cool the roll. At block 606, water can be sprayed on the bottom work roll to cool the roll. In some cases, temperature of the bottom work roll can be monitored or predicted and based on the extent water sprayed during block 606 draws heat away from the bottom work roll, the amount of oil sprayed to the bottom work roll at block 604 can be cut back. In some cases, at optional block 608, oil no longer sprayed on the bottom work roll at block 604 can be diverted from to the top oil spray at block 602.

At optional block 610, the flatness of the strip being rolled can be measured. Based on this measurement, the laterally-controlled cooling of the work roll(s) (e.g., bottom work roll, top work roll, or a combination thereof) can be performed at block 612. Laterally-controlled cooling can involve increasing or decreasing any combination of oil applied to the top work roll at block 602, oil applied to the bottom work roll at block 604, and water applied to the bottom work roll at block 606.

Using the concepts described herein, a top work roll 102 can be cooled with significantly more oil than otherwise available from conventional oil-cooled mills without any investment in pumping capacity, because most of the oil is diverted from the bottom oil spray 116 to the top oil spray 112. Advantageously, the top work roll 102 stays much cooler due to the additional volume of oil being sprayed thereon, while the bottom work roll 104 is cooled by water-cooling or a combination of oil- and water-cooling.

Additionally, work rolls (e.g., top work roll 102 and bottom work roll 104) can be cooled sufficiently and efficiently without equipment or processes for specially mixing oil and water into a particular emulsion or mechanical dispersion. Instead, in some aspects, easily-separated oil and water can each be individually provided to the bottom work roll as necessary.

The hybrid oil- and water-cooled mill, as described herein, can provide a way to upgrade and increase productivity of existing mills. An existing oil-cooled mill can be upgraded to provide improved flatness and lower fire risk at a lower cost than a full conversion to a water-cooled mill. The hybrid mill, as described herein, can dynamically adjust cooling from only oil-based cooling all the way through full or almost full water-based cooling on the bottom work roll 104 and diverting all or almost all of the oil to cool the top work roll 102. The hybrid mill described herein can provide superior flatness control, can allow for fast mill speeds, can allow for high reductions to be taken on each pass, can reduce the number of passes necessary to reach the target gauge, and can operate at lower costs.

Individual embodiments may be described as processes that are depicted as flowcharts, flow diagrams, data flow diagrams, structure diagrams, or block diagrams. Although a flowchart may describe operations as a sequential process, many of the operations can be performed in parallel or concurrently. In addition, the order of the operations may be re-arranged. A process is terminated when its operations are completed, but could have additional steps not included in a figure.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a hybrid cooling system for a rolling mill, comprising a top oil spray header proximate a top work roll; a bottom oil spray header proximate a bottom work roll; and a water spray header proximate the bottom work roll.

Example 2 is the system of example 1, further comprising an oil supply in fluid connection with the top oil spray header and the bottom oil spray header; and a valve positioned inline between the bottom oil spray header and the oil supply, wherein the valve is actuatable to divert oil from the bottom oil spray header to the top oil spray header.

Example 3 is the system of examples 1 or 2, wherein the water spray header is located proximate an exit side of the bottom work roll.

Example 4 is the system of examples 1-3, further comprising a drain positioned to collect sprayed oil and water; and a water and oil separation tank coupled to the common drain and having a water extraction port coupled to the water spray header and an oil extraction port coupled to the top oil spray header and bottom oil spray header.

Example 5 is the system of examples 1-4, further comprising a flatness measurement system; and a controller coupled to the flatness measurement system and to a plurality of individually-controllable nozzles, wherein the plurality of individually-controllable nozzles is located on the top oil spray header, the bottom oil spray header, or the water spray header.

Example 6 is the system of examples 1-5, further comprising a wiper positioned proximate the bottom work roll to remove water from the bottom work roll.

Example 7 is a method of upgrading a mill cooling system, comprising providing an oil-based cooling system including a top oil spray header proximate a top work roll and a bottom oil spray header proximate a bottom work roll; and installing a water spray header proximate the bottom work roll.

Example 8 is the method of example 7, wherein installing the water spray header includes installing the water spray header proximate an exit side of the bottom work roll.

Example 9 is the method of examples 7 or 8, further comprising installing a drain positioned to collect water and oil from at least the bottom work roll; coupling a water and oil separation tank to the drain; coupling a water extraction port of the water and oil separation tank to the water spray header; and coupling an oil extraction port of the water and oil separation tank to the bottom oil spray header.

Example 10 is the method of examples 7-9, further comprising positioning a flatness measurement system proximate an exit side of the bottom work roll; and coupling a controller to the flatness measurement system and to a plurality of individually-controllable nozzles, wherein the plurality of individually-controllable nozzles is located on the top oil spray header, the bottom oil spray header, or the water spray header.

Example 11 is a method of cooling a rolling mill, comprising applying a top oil spray to a top work roll; applying a bottom oil spray to a bottom work roll; and applying a water spray to the bottom work roll.

Example 12 is the method of example 11, wherein applying the water spray includes applying the water spray to an exit side of the bottom work roll.

Example 13 is the method of examples 11 or 12, further comprising removing water from the bottom work roll using a wiper.

Example 14 is the method of examples 11-13, further comprising diverting oil from the bottom oil spray to the top oil spray.

Example 15 is the method of examples 11-14, further comprising measuring flatness of a metal strip rolled using the top work roll and the bottom work roll to obtain flatness measurements; and controlling the flatness of the metal strip using the flatness measurements, wherein controlling the flatness of the metal strip includes adjusting at least one of the top oil spray, the bottom oil spray, or the water spray.

Example 16 is the method of example 15, wherein measuring the flatness of the metal strip includes obtaining an individual flatness measurement for each of a plurality of lateral zones, wherein each of the plurality of lateral zones corresponds to a respective nozzle of a plurality of laterally-spaced nozzles, and wherein controlling the flatness of the metal strip includes individually controlling each of the plurality of laterally-spaced nozzles based on the respective individual flatness measurement.

Example 17 is the method of example 16, wherein the water spray exits via the plurality of laterally-spaced nozzles.

Example 18 is the method of examples 16, wherein the bottom oil spray exits via the plurality of laterally-spaced nozzles.

Example 19 is the method of example 18, wherein applying the water spray includes extracting heat from the bottom work roll evenly across a width of the bottom work roll.

Example 20 is the method of examples 11-19, wherein applying the water spray and applying the bottom oil spray collectively comprise extracting heat from the bottom roll, wherein applying the water spray includes extracting a majority of the heat, and wherein applying the bottom oil spray includes lubricating the bottom work roll.

What is claimed is:

1. A hybrid cooling system for a rolling mill, comprising:

a top oil spray header proximate a top work roll;

a bottom oil spray header proximate a bottom work roll;

a water spray header proximate the bottom work roll, wherein the water spray header is positioned only below a pass line of a metal strip through the rolling mill;

an oil supply in fluid connection with the top oil spray header and the bottom oil spray header;

a valve positioned inline between the bottom oil spray header and the oil supply, wherein the valve is actuatable to divert oil from the bottom oil spray header to the top oil spray header; and a processor couplable to the valve, wherein the processor is configured to actuate the valve to divert oil from the bottom oil spray header to the top oil spray header to account for additional cooling provided by the water spray header proximate the bottom work roll, and wherein the processor is configured to determine a temperature of the bottom work roll, and wherein the processor is configured to actuate the valve based on the temperature of the bottom work roll.

2. The system of claim 1, wherein the water spray header is located proximate an exit side of the bottom work roll.

3. The system of claim 1, further comprising:

a drain positioned to collect sprayed oil and water; and a water and oil separation tank coupled to the common drain and having a water extraction port coupled to the water spray header and an oil extraction port coupled to the top oil spray header and bottom oil spray header.

4. The system of claim 1, further comprising:

a flatness measurement system; and a controller coupled to the flatness measurement system and to a plurality of individually-controllable nozzles, wherein the plurality of individually-controllable nozzles is located on the top oil spray header, the bottom oil spray header, or the water spray header.

5. The system of claim 1, further comprising a wiper positioned proximate the bottom work roll to remove water from the bottom work roll.

6. A method of upgrading a mill cooling system, comprising:

providing an oil-based cooling system including a top oil spray header proximate a top work roll and a bottom oil spray header proximate a bottom work roll, wherein the top oil spray header and the bottom oil spray header are fluidly coupled to an oil supply;

installing a water spray header proximate the bottom work roll;

positioning a valve inline between the bottom oil spray header and the oil supply, wherein the valve is actuatable to divert oil from the bottom oil spray header to the top oil spray header; and coupling the valve to a processor, wherein the processor is configured to determine a temperature of the bottom work roll and based on the temperature of the bottom work roll, actuate the valve to divert oil from the bottom oil spray header to the top oil spray header to account for additional cooling provided by the water spray header proximate the bottom work roll.

7. The method of claim 6, wherein installing the water spray header includes installing the water spray header proximate an exit side of the bottom work roll.

8. The method of claim 6, further comprising:

installing a drain positioned to collect water and oil from at least the bottom work roll;

coupling a water and oil separation tank to the drain;

coupling a water extraction port of the water and oil separation tank to the water spray header; and coupling an oil extraction port of the water and oil separation tank to the bottom oil spray header.

9. The method of claim 6, further comprising:

positioning a flatness measurement system proximate an exit side of the bottom work roll; and coupling a controller to the flatness measurement system and to a plurality of individually-controllable nozzles, wherein the plurality of individually-controllable nozzles is located on the top oil spray header, the bottom oil spray header, or the water spray header.

10. A method of cooling a rolling mill, comprising:

applying a top oil spray to a top work roll from an oil supply;

applying a bottom oil spray to a bottom work roll from the oil supply;

applying a water spray to only the bottom work roll; and diverting oil from the bottom oil spray to the top oil spray to account for additional cooling provided by applying the water spray to the bottom work roll, wherein diverting the oil includes increasing the top oil spray and decreasing the bottom oil spray, and wherein diverting oil from the bottom oil spray to the top oil spray comprises:

determining a temperature of the bottom work roll; and based on the temperature of the bottom work roll, actuate a valve to divert oil from the bottom oil spray to the top oil spray to account for additional cooling provided by applying the water spray to the bottom work roll.

11. The method of claim 10, wherein applying the water spray includes applying the water spray to an exit side of the bottom work roll.

12. The method of claim 10, further comprising removing water from the bottom work roll using a wiper.

13. The method of claim 10, further comprising:

measuring flatness of a metal strip rolled using the top work roll and the bottom work roll to obtain flatness measurements; and controlling the flatness of the metal strip using the flatness measurements, wherein controlling the flatness of the metal strip includes adjusting at least one of the top oil spray, the bottom oil spray, or the water spray.

14. The method of claim 13, wherein measuring the flatness of the metal strip includes obtaining an individual flatness measurement for each of a plurality of lateral zones, wherein each of the plurality of lateral zones corresponds to a respective nozzle of a plurality of laterally-spaced nozzles, and wherein controlling the flatness of the metal strip includes individually controlling each of the plurality of laterally-spaced nozzles based on the respective individual flatness measurement.

15. The method of claim 14, wherein the water spray exits via the plurality of laterally-spaced nozzles.

16. The method of claim 14, wherein the bottom oil spray exits via the plurality of laterally-spaced nozzles.

17. The method of claim 16, wherein applying the water spray includes extracting heat from the bottom work roll evenly across a width of the bottom work roll.

18. The method of claim 10, wherein applying the water spray and applying the bottom oil spray collectively comprise extracting heat from the bottom roll, wherein applying the water spray includes extracting a majority of the heat, and wherein applying the bottom oil spray includes lubricating the bottom work roll.

* * * * *